US010330282B2

(12) United States Patent
Shih

(10) Patent No.: US 10,330,282 B2
(45) Date of Patent: Jun. 25, 2019

(54) VEHICLE LAMP LENS

(71) Applicant: T.Y.C. BROTHER INDUSTRIAL CO., LTD., Tainan (TW)

(72) Inventor: Ming-Chih Shih, Tainan (TW)

(73) Assignee: T.Y.C. BROTHER INDUSTRIAL CO., LTD., Tainan (TW)

( * ) Notice: Subject to any disclaimer, the term of this patent is extended or adjusted under 35 U.S.C. 154(b) by 0 days.

(21) Appl. No.: 15/695,394

(22) Filed: Sep. 5, 2017

(65) Prior Publication Data

US 2019/0072256 A1 Mar. 7, 2019

(51) Int. Cl.

| | |
|---|---|
| ***F21V 7/00*** | (2006.01) |
| ***F21V 7/22*** | (2018.01) |
| ***F21V 5/04*** | (2006.01) |

(52) U.S. Cl.

CPC ..... *F21V 7/0091* (2013.01); *F21V 5/04* (2013.01); *F21V 7/22* (2013.01)

(58) Field of Classification Search

CPC ..... F21V 7/0091; F21V 7/22; F21V 5/04

USPC ..... 362/348

See application file for complete search history.

(56) References Cited

U.S. PATENT DOCUMENTS

| | | | | |
|---|---|---|---|---|
| 2008/0165548 | A1* | 7/2008 | Misawa | B60Q 1/2607 362/487 |
| 2018/0128442 | A1* | 5/2018 | Suwa | F21S 41/32 |
| 2018/0245763 | A1* | 8/2018 | Oshima | B60Q 1/2607 |

* cited by examiner

*Primary Examiner* — Toan C Ly
(74) *Attorney, Agent, or Firm* — Burris Law, PLLC

(57) ABSTRACT

A lamp lens is adapted to transmit light, and includes spaced-apart light input and output surfaces and a reflecting surface. The light input surface has a surrounding surface portion and an end surface portion connected to a front end of the surrounding surface portion. The reflecting surface extends from the light input surface to the light output surface, and has a plurality of reflecting segments and optical structures. The reflecting segments are adapted for total reflection of a portion of the light which enters the lamp lens through the light input surface. Each adjacent two of the reflecting segments forma stepped surface structure. The optical structures are adapted to prevent total reflection of a portion of the light.

6 Claims, 5 Drawing Sheets

VEHICLE LAMP LENS

FIELD

The disclosure relates to a lamp lens, and more particularly to a lamp lens for vehicles.

BACKGROUND

A conventional vehicle lamp generally includes a reflecting seat for reflecting light to project the same forwardly out of the conventional vehicle lamp. The reflecting seat has a reflecting surface generally formed through a vacuum coating process. However, choice of the material of the body of the reflecting seat is limited due to the high temperature condition required by the vacuum coating process. In addition, the bonding ability of a coating layer on the inner side of the body of the reflecting seat also restricts the choice of the material of the body of the lamp cover. Moreover, since the vacuum coating process often causes the reflecting surface to be uneven, the optical precision of the conventional vehicle lamp is affected, thereby resulting in an undesired projected light shape, and thereby also affecting the reflectability of light which leads to great light loss.

Accordingly, a vehicle lamp lens has previously been designed specifically to improve the abovementioned drawbacks. Light that enters such lamp lens will exit through a light output surface of the lamp lens after undergoing total internal reflection (TIR). According to a theoretical calculation, reflectivity of such lamp lens may reach 100%. In comparison with the vehicle lamp having the abovementioned vacuum-coated reflecting seat, a vehicle lamp equipped with the previously designed lamp lens relatively has a reduced light loss and an improved optical precision.

Taiwanese Patent No. 1491833 discloses a vehicle illumination apparatus including a light source and a collimator lens. The collimator lens guides light emitted from the light source through TIR. However, the output light from such collimator lens may result in undesired residual light on the illumination plane, which causes occurrence of glare and hence negatively affects passerby and drivers. For example, light emitted from a low-beam lamp may generate residual light at a zone above the cut-off line.

SUMMARY

Therefore, an object of the disclosure is to provide a lamp lens that can alleviate at least one of the drawbacks associated with the abovementioned prior art.

The lamp lens is adapted to transmit light that is emitted from a lighting member. The lamp lens includes a light input surface, a light output surface, and a reflecting surface. The light input surface is adapted to face the lighting member and has a surrounding surface portion and an end surface portion. The surrounding surface portion surrounds an optical axis extending in a front-rear direction. The end surface portion is connected to a front end of the surrounding surface portion and is disposed on the optical axis. The light output surface is spaced apart from the light input surface along the optical axis. The reflecting surface extends from the light input surface to the light output surface, surrounds the optical axis, and has a plurality of reflecting segments and a plurality of optical structures. The reflecting segments are adapted for total reflection of a portion of the light which enters the lamp lens through the light input surface. Each adjacent two of the reflecting segments form a stepped surface structure. The optical structures are adapted to prevent total reflection of a portion of the light.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
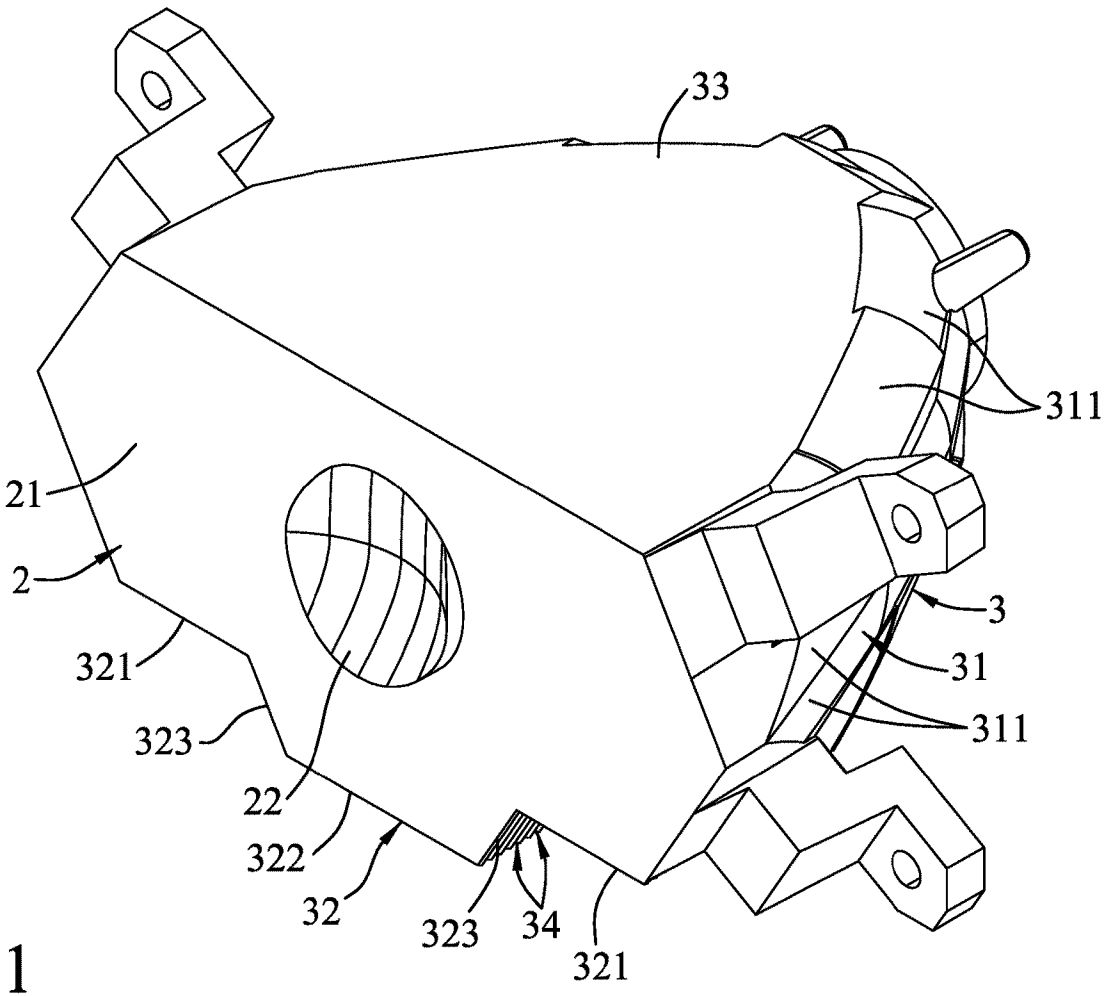
FIG. 1 is a perspective view of an embodiment of a lamp lens according to the present disclosure.
Figure 2:
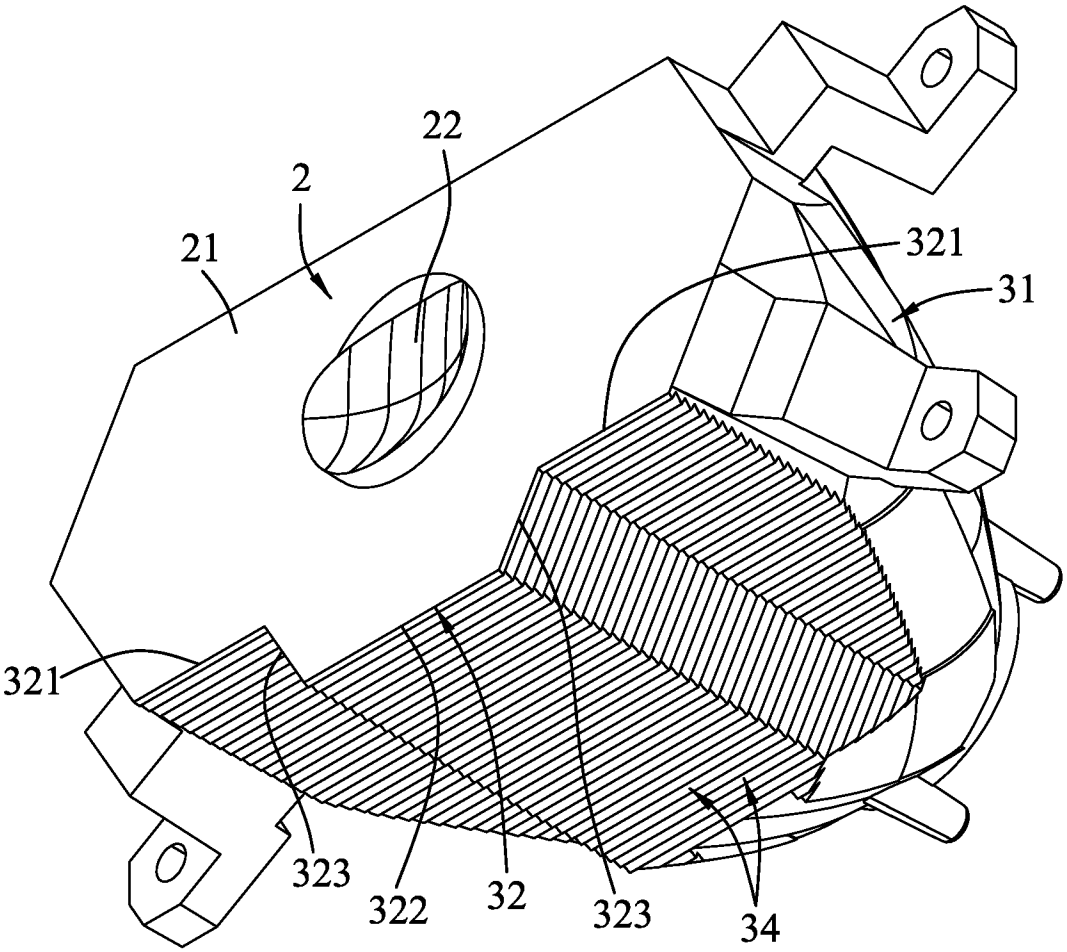
FIG. 2 is another perspective view of the embodiment.
Figure 3:
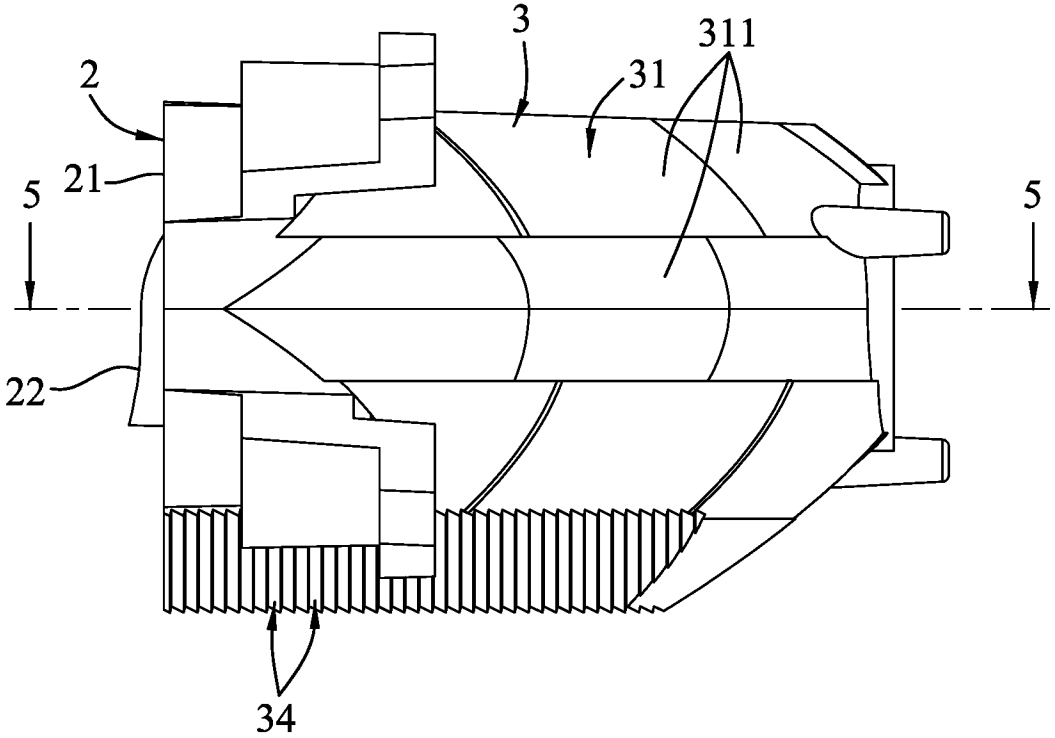
FIG. 3 is a side view of the embodiment.

Referring to FIGS. 1 to 4, an embodiment of a lamp lens according to the disclosure is adapted to transmit light that is emitted from a lighting member 9 (see FIG. 4), which may be a light-emitting diode (LED). The lamp lens may be made of a light-transmissive resin material. The lamp lens includes a light input surface 1, a light output surface 2, and a reflecting surface 3.

The light input surface 1 is adapted to face the lighting member 9. The light input surface 1 has a surrounding surface portion 11 surrounding an optical axis (L) that extends in a front-rear direction, and an end surface portion 12 connected to a front end of the surrounding surface portion 11 and disposed on the optical axis (L).

The light output surface 2 is disposed in front of and spaced apart from the light input surface 1 along the optical axis (L). The light output surface 2 has a ring surface portion 21 surrounding the optical axis (L), and a central surface portion 22 disposed on the optical axis (L) and surrounded by the ring surface portion 21. The ring surface portion 21 is planar and smooth without any pattern formed thereon. The ring surface 21 is adapted for passage of a portion of the light which enters the lamp lens through the surrounding surface portion 11 of the light input surface 1. The central surface portion 22 is a curved surface, and is designed to possess multiple parts that have different curvatures. Specifically, the central surface portion 22 has an upper segment recessed from the ring surface portion 21, and a lower segment protruding from the ring surface portion 21. The central surface portion 22 is adapted for passage of a portion of the light which enters the lamp lens through the end surface portion 12 of the light input surface 1.

The reflecting surface 3 extends from the light input surface 1 to the ring surface portion 21 of the light output surface 2 (i.e., a front end of the reflecting surface 3 is connected to the ring surface portion 21 of the light output surface 2), and surrounds the optical axis (L). The reflecting surface 3 has two first reflecting portions 31 spaced apart from each other in a left-right direction that is perpendicular to the front-rear direction, a second reflecting portion 32 connected between bottom edges of the first reflecting portions 31, and a third reflecting portion 33 connected between top edges of the first reflecting portions 31.

Each of the first reflecting portions 31 has a plurality of reflecting segments 311 adapted for total reflection of a portion of the light which enters the lamp lens through the light input surface 1. Each adjacent two of the reflecting segments 311 form a stepped surface structure. The second reflecting portion 32 has two first sections 321 spaced apart from each other in the left-right direction, a second section 322 disposed between and lower than the first sections 321, and two third sections 323. Each of the third sections 323 interconnects an inner end of a respective one of the first sections 321 and the second section 322. The second reflecting portion 32 of the reflecting surface 3 is formed with a plurality of optical structures 34 that are adapted to prevent total reflection of a portion of the light.

Figure 4:
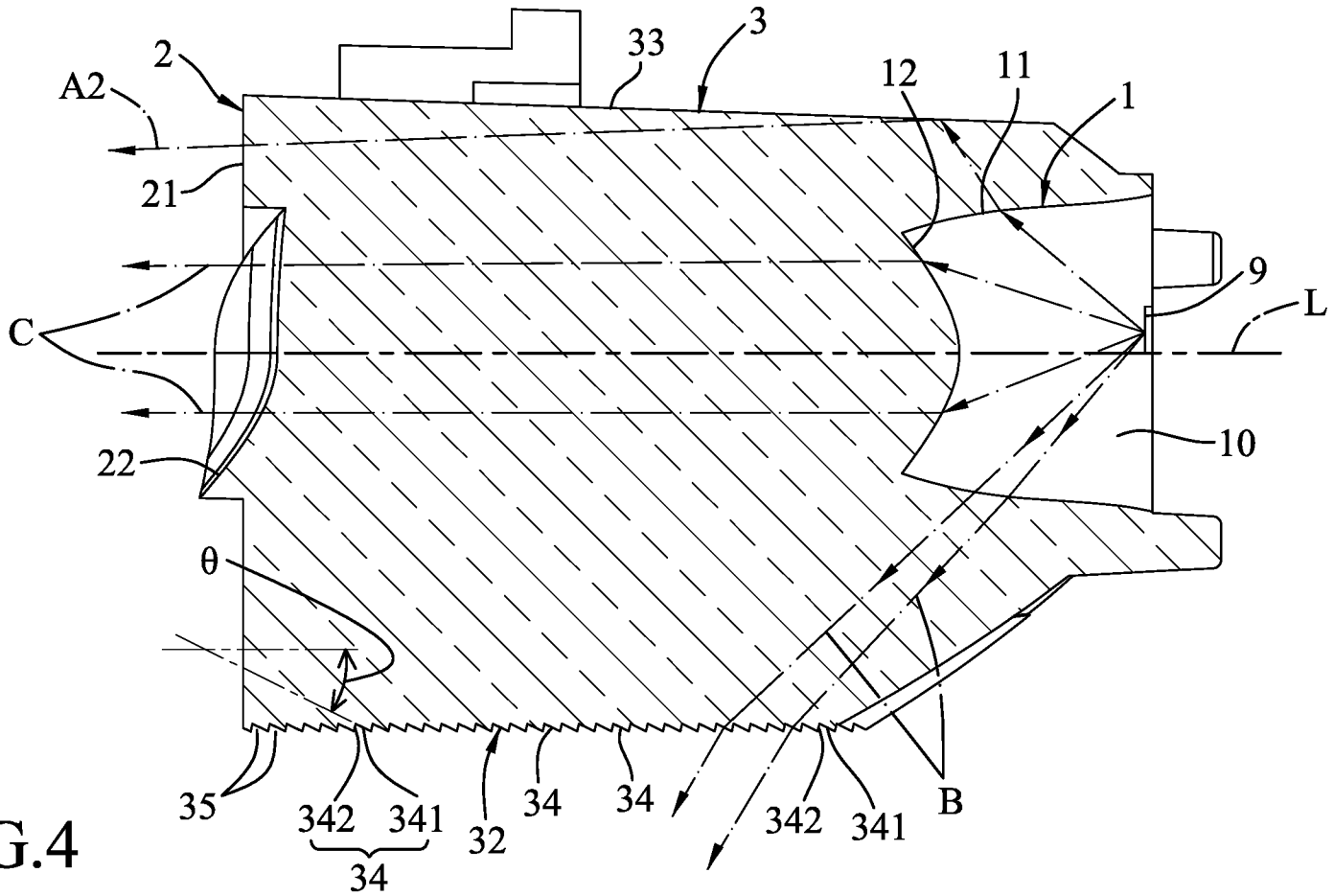
FIG. 4 is a side sectional view of the embodiment.

Referring to FIG. 4, the optical structures 34 are arranged in the front-rear direction. Each of the optical structures 34 has a main surface 341 adapted for passage of a portion of the light therethrough, and a connecting surface 342 connected to the main surface 341 and cooperating with the main surface 341 to define a groove 35 that extends substantially in the left-right direction. The main and connecting surfaces 341, 342 of the optical structures 34 are alternately arranged in the front-rear direction. For each of the optical structures 34, an imaginary plane extending along the main surface 341 and the optical axis (L) cooperatively define an acute angle (θ) larger than 18 degrees for improving prevention of the total reflection of the portion of the light passing through the main surface 341. If the acute angle (θ) is less than or equal to 18 degrees, the portion of the light passing through the main surface 341 is more likely to generate glare above the cut-off line.

Figure 5:
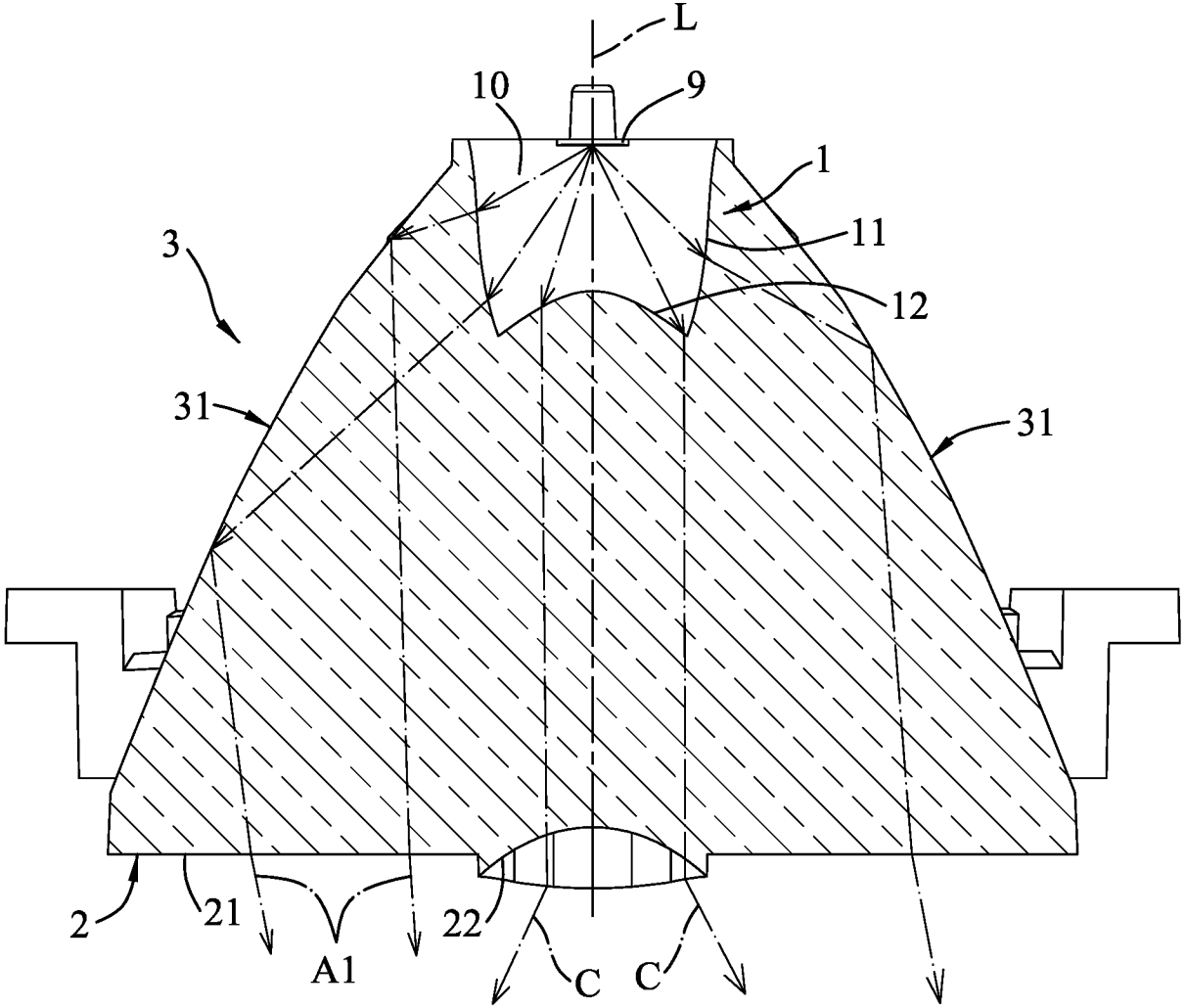
FIG. 5 is a sectional view taken along line 5-5 in FIG. 3.

Referring to FIGS. 1, 4 and 5, in use, a part of the light (as indicated by arrows (A1, A2, B) in FIGS. 4 and 5) emitted from the lighting member 9 enters the lamp lens through the surrounding surface portion 11 of the light input surface 1. The other part of the light (as indicated by arrows (C) in FIGS. 4 and 5) emitted from the lighting member 9 enters the lamp lens through the end surface portion 12 of the light input surface 1. Since the end surface portion 12 curves rearwardly away from the light output surface 2, the other part of the light would concentrate after passing through the end surface portion 12, travel toward the light output surface 2 in a direction that is substantially parallel to the optical axis (L), and finally exit through the central surface portion 22.

On the other hand, the part of the light which enters the lamp lens through the surrounding surface portion 11 is divided into a first part of the light (as indicated by arrows (A1) in FIG. 5) reflected by the first reflecting portions 31 of the reflecting surface 3, a second part of the light (as indicated by arrow (A2) in FIG. 4) reflected by the third reflecting portion 33 of the reflecting surface 3, and a third part of the light (as indicated by arrows (B) in FIG. 4) passing through the second reflecting portion 32 of the reflecting surface 3. After being reflected (mostly through TIR), the first and second parts of the light (as indicated by arrows (A1, A2)) exit through the ring surface portion 21 of the light output surface 2 to result in a uniform light output. All of the parts of the light can cooperatively form a light shape in conformity with local laws on a projection plane that is in front of the lamp lens, and can form a cut-off line at a proper position.

Furthermore, since the configuration of the optical structures 34 is designed to prevent total reflection, the third part of the light (as indicated by arrows (B)) can be refracted to exit the lamp lens through the main surfaces 341 of the optical structures 34. It should be noted that, without the optical structures 34, the third part of the light might be reflected toward the light output surface 2 and cause residual light around the cut-off line which generates undesired glare.

It should be noted that, the optical structures 34 are formed by a numerical control machine in this embodiment, but are not limited to such formation process in other embodiments. The optical structures 34 may be configured as textured structures that are adapted for facilitating diffuse reflection of the light emitted thereto from the lighting member 9. Such textured structures may also prevent total reflection of the light and reduce residual light. To make the textured structures, the second reflecting portion 32 of the reflecting surface 3 is made rough by a wet-etching process. In addition, the location of the optical structures 34 is not limited to the second reflecting portion 32, namely, the optical structures 34 may be disposed on a desired portion of the reflecting surface 3 in other embodiments.

It is worth mentioning that since the reflecting segments 311 of the first reflecting portions 31 have different curvatures to optimally reflect the first part of the light with different incident angles, the first part of the light can be reflected at different proper reflecting angles and paths for projecting light shapes that are uniformly diffused. In addition, the first and second parts of the light can be projected below the cut-off line for preventing the zone above the cut-off line from being too bright to comply with the local laws. Moreover, with a proper design of the curvatures of the reflecting segments 311, a width of the output light in the left-right direction can be increased.

Furthermore, by changing the curvature of the central surface portion 22 of the light output surface 2 during the manufacturing process of the lamp lens, the width of the output light in the lift-right direction can also be increased, and the position of the cut-off line can be adjusted. It has been found via experiment that if the central surface portion 22 is a planar surface, residual light might occur around the cut-off line, which might also be against the local laws. By virtue of the different curvatures of the reflecting segments 311 and the curved central surface portion 22, the saturation, uniformity and light shape of the output light, and the position of the cut-off line can be controlled, thereby increasing optical precision. It should be noted that, while the ring surface portion 21 and the central surface portion 22 of the light output surface 2 are exemplified to have different curvatures, they may be arranged not to be at the same plane in other embodiments (for example, the central surface portion 22 may be in a rear side of the ring surface portion 21) to form two different regions of the light output surface 2.

In summary, due to the optical structures 34, total reflection of the portion of the light passing therethrough may be prevented, so as to reduce residual light and glare. As a result, the lamp lens according to the present disclosure can improve driving safety.

What is claimed is:

1. A lamp lens adapted to transmit light that is emitted from a lighting member (9), said lamp lens comprising:
- a light input surface (1) adapted to face the lighting member (9), and having
  - a surrounding surface (11) portion that surrounds an optical axis (L) extending in a front-rear direction, and
  - an end surface portion (12) that is connected to a front end of said surrounding surface portion (11), and that is disposed on the optical axis (L);
- a light output surface (2) spaced apart from said light input surface (1) along the optical axis (L); and
- a reflecting surface (3) extending from said light input surface (1) to said light output surface (2), surrounding the optical axis (L), and having
  - a plurality of reflecting segments (311) that are adapted for total reflection of a portion of the light which enters said lamp lens through said light input surface (1), each adjacent two of said reflecting segments (311) forming a stepped surface structure, and a plurality of optical structures (34) that are arranged in the front-rear direction and that are adapted to prevent total reflection of a portion of the light, each of said optical structures (34) defining a groove (35) that extends substantially in a left-right direction perpendicular to the front-rear direction, and having a main surface (341) adapted for passage of a portion of the light therethrough, and a connecting surface (342) connected to said main surface (341) and cooperating with said main surface (341) to define said groove (35), said main and connecting surfaces (341, 342) being alternatively arranged in the front-rear direction.

2. The lamp lens as claimed in claim 1, wherein said reflecting surface (3) has:

two first reflecting portions (31) spaced apart from each other in a left-right direction that is perpendicular to the front-rear direction; and a second reflecting portion (32) connected between bottom edges of said first reflecting portions (31) and being formed with said optical structures (34).

3. The lamp lens as claimed in claim 1, wherein for each of said optical structures (34), an imaginary plane extending along said main surface (341) and the optical axis (L) cooperatively define an acute angle that is larger than 18 degrees.

4. The lamp lens as claimed in claim 1, wherein said optical structures (34) are configured as textured structures adapted for facilitating diffuse reflection of the light emitted thereto.

5. The lamp lens as claimed in claim 1, wherein said light output surface (2) has:

a ring surface portion (21) connected to said reflecting surface (3), surrounding the optical axis (L), and adapted for passage of a portion of the light which enters said lamp lens through said surrounding surface portion (11) of said light input surface (1) and which is reflected by said reflecting surface (3); and a central surface portion (22) disposed on the optical axis (L), surrounded by said ring surface portion (21), being a curved surface, and adapted for passage of a portion of the light which enters said lamp lens through said end surface portion (12) of said light input surface (1).

6. The lamp lens as claimed in claim 5, wherein said ring surface portion (21) of said light output surface (2) is planar.

* * * * *